United States Patent [19]

Aoki et al.

[11] Patent Number: 4,686,177

[45] Date of Patent: Aug. 11, 1987

[54] SILVER HALIDE COLOR PHOTOGRAPHIC LIGHT-SENSITIVE MATERIALS

[75] Inventors: Kozo Aoki; Michio Ono; Naoki Saito; Makoto Umemoto, all of Kanagawa, Japan

[73] Assignee: Fuji Photo Film Co., Ltd., Kanagawa, Japan

[21] Appl. No.: 760,852

[22] Filed: Jul. 31, 1985

[30] Foreign Application Priority Data

Jul. 31, 1984 [JP] Japan ..... 59-161239

[51] Int. Cl.[4] ..... G03C 1/40; G03C 7/34

[52] U.S. Cl. ..... 430/553; 430/548; 430/552

[58] Field of Search ..... 430/548, 552, 553

[56] References Cited

U.S. PATENT DOCUMENTS

| | | | |
|---|---|---|---|
| 2,369,929 | 2/1945 | Vittum et al. | 430/552 |
| 2,895,826 | 7/1959 | Salimen et al. | 430/552 |
| 3,772,002 | 11/1973 | Ramello | 430/553 |
| 3,998,642 | 12/1976 | Lau et al. | 430/553 |
| 4,455,366 | 6/1984 | Hirano et al. | 430/548 |
| 4,495,272 | 1/1985 | Yagihara et al. | 430/552 |
| 4,496,650 | 1/1985 | Yagihata et al. | 430/548 |
| 4,511,647 | 4/1985 | Hirano et al. | 430/548 |
| 4,564,590 | 1/1986 | Sasaki et al. | 430/553 |
| 4,581,324 | 4/1986 | Wolff et al. | 430/553 |

*Primary Examiner*—Richard L. Schilling

*Attorney, Agent, or Firm*—Sughrue, Mion, Zinn, Macpeak, and Seas

[57] ABSTRACT

A silver halide color photographic material having excellent color fastness against light, heat and heat with humidity, particularly against light irradiation, containing a cyan coupler of the general formula (I):

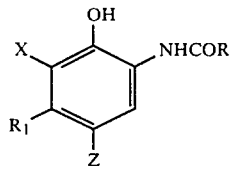

(I)

wherein R represents an unsubstituted linear or branched aliphatic group or a linear or branched aliphatic group substituted with one or more substituents selected from a chlorine atom, an alkoxy group, an alkylthio group, an arylthio group, an alkylsulfonyl group, an arylsulfonyl group, a sulfonamido group, an acylamino group, an alkyloxycarbonyl group, an aryloxycarbonyl group, a carbamoyl group, an alkylcarbonyloxy group, an arylcarbonyloxy group, a carboxyl group and a hydroxyl group; $R_1$ represents an unsubstituted or substituted linear or branched alkyl group having 2 to 15 carbon atoms; X is a hydrogen atom, a halogen atom, an alkyl group, an an alkoxy group or an acylamino group; Z is a hydrogen atom or a residue which may be removed in an oxidation coupling reaction with a developing agent; and said R may optionally form a dimeric or higher polymeric structure.

2 Claims, No Drawings

SILVER HALIDE COLOR PHOTOGRAPHIC LIGHT-SENSITIVE MATERIALS

FIELD OF THE INVENTION

The present invention relates to a silver halide color photographic light-sensitive material containing a new cyan coupler.

BACKGROUND OF THE INVENTION

A silver halide photographic light-sensitive material is exposed and then subjected to a color development treatment, whereby a developing agent such as an aromatic primary amine, oxidized by the silver halide contained in the material, reacts with a color forming coupler to form a color image. In this process, in general, a color reproduction method based on a subtractive color process is often utilized where yellow, magenta and cyan color images are formed for the purpose of reproduction of blue, green and red colors, respectively, the yellow, magenta and cyan being complementary colors of blue, green and red, respectively.

Phenols and naphthols are conventionally widely used as a cyan coupler. However, conventional phenols and naphthols have some problems from the standpoint of the preservability of the color images formed. For example, color images obtained using a 2-acylaminophenol cyan coupler, as described in U.S. Pat. Nos. 2,367,531, 2,369,929, 2,423,730 and 2,801,171, in general, have poor heat fastness; color images obtained using a 2,5-diacylaminophenol cyan coupler, as described in U.S. Pat. Nos. 2,772,162 and 2,895,826, in general, have poor light fastness; and a 1-hydroxy-2-naphthamide cyan coupler, in general, has insufficient both light and heat fastness (especially in the presence of humidity).

SUMMARY OF THE INVENTION

An object of the present invention is to eliminate these defects and to provide new cyan couplers capable of providing color images having good preservation stability for a long period of time.

Accordingly, the present invention provides a silver halide photographic light-sensitive material containing a cyan coupler of the general formula (I):

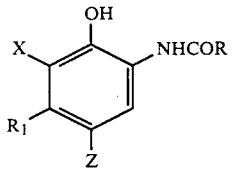

(I)

wherein R represents an unsubstituted linear or branched aliphatic group or a linear or branched aliphatic group substituted with one or more substituents selected from a chlorine atom, an alkoxy group, an alkylthio group, an arylthio group, an alkylsulfonyl group, an arylsulfonyl group, a sulfonamido group, an acylamino group, an alkyloxycarbonyl group, an aryloxycarbonyl group, a carbamoyl group, an alkylcarbonyloxy group, an arylcarbonyloxy group, a carboxyl group and a hydroxyl group; $R_1$ represents an unsubstituted or substituted, linear or branched alkyl group having 2 to 15 carbon atoms; X is a hydrogen atom, a halogen atom, an alkyl group, an alkoxy group or an acylamino group; Z is a hydrogen atom or a residue which may be removed in an oxidation coupling reaction with a developing agent; where R may optionally form a dimeric or higher polymeric structure.

DETAILED DESCRIPTION OF THE INVENTION

The substituents R, $R_1$, X and Z in the general formula (I) are explained in detail in the following description.

R in the formula (I) represents an unsubstituted aliphatic group preferably having 1 to 32 carbon atoms (which may be linear or branched and may optionally contain one or more unsaturated bonds, such as a methyl group, a butyl group, a tert-butyl group, a tridecyl group, a butenyl group, an ethynyl group, etc.); or represents an aliphatic group preferably having 1 to 32 carbon atoms, which is substituted with one or more substituents selected from a chlorine atom, an alkoxy group (such as a methoxy group, a butoxy group, a dodecyloxy group, etc.), an alkylthio group (such as an ethylthio group, a hexadecylthio group, etc.), an arylthio group (such as a phenylthio group, a naphthylthio group, etc.), an alkylsulfonyl group (such as a methylsulfonyl group, a butylsulfonyl group, etc.), an arylsulfonyl group (such as a phenylsulfonyl group, etc.), a sulfonamido group (such as a methanesulfonamido group, a phenylsulfonamido group, etc.), an acylamino group (such as an acetylamino group, a tetradecanamido group, a benzoylamino group, etc.), an alkyloxycarbonyl group (such as an ethoxycarbonyl group, a tetradecyloxycarbonyl group, etc.), an aryloxycarbonyl group (such as a phenoxycarbonyl group, etc.), a carbamoyl group (such as a dimethylcarbamoyl group, a dodecylcarbamoyl group, an N-methylphenylcarbamoyl group, etc.), an alkylcarbonyloxy group (such as an acetoxy group, a nonylcarbonyloxy group), an arylcarbonyloxy group (such as a benzoyloxy group, etc.), a carboxyl group and a hydroxyl group.

$R_1$ in the formula (I) represents an unsubstituted or substituted, linear or branched alkyl group having 2 to 15 carbon atoms.

Substituents acceptable for $R_1$ in the formula (I) are an aryl group, a heterocyclic group, an alkoxy group (such as a methoxy group, a 2-methoxyethoxy group, etc.), an aryloxy group (such as a 2,4-di-tert-amylphenoxy group, a 2-chlorophenoxy group, a 4-cyanophenoxy group, etc.), an alkenyloxy group (such as a 2-propenyloxy group, etc.), an acyl group (such as an acetyl group, a benzoyl group, etc.), an ester group (such as a butoxycarbonyl group, a phenoxycarbonyl group, an acetoxy group, a benzoyloxy group, a butoxysulfonyl group, a toluenesulfonyloxy group, etc.), an amido group (such as an acetylamino group, an ethylcarbamoyl group, a dimethylcarbamoyl group, a methanesulfonamido group, a butylsulfamoyl group, etc.), a sulfamido group (such as a dipropylsulfamoylamino group, etc.), an imido group (such as a succinimido group, a hydantoinyl group, etc.), a ureido group (such as a phenylureido group, a dimethylureido group, etc.), an aliphatic or aromatic sulfonyl group (such as a methanesulfonyl group, a phenylsulfonyl group, etc.), an aliphatic, aromatic or heterocyclic thio group (such as an ethylthio group, a phenylthio group, etc.), a hydroxyl group, a cyano group, a carboxyl group, a nitro group, a sulfo group, a halogen atom, etc.

X in the formula (I) represents a hydrogen atom, a halogen atom, an alkyl group, an alkoxy group or an acylamino group.

Z in the formula (I) represents a hydrogen atom or a residue removed upon coupling, and examples thereof are a halogen atom (such as a fluorine atom, a chlorine atom, a bromine atom, etc.), an alkoxy group (such as an ethoxy group, a dodecyloxy group, a methoxyethylcarbamoylmethoxy group, a carboxypropyloxy group, a methylsulfonylethoxy group, etc.), an aryloxy group (such as a 4-chlorophenoxy group, a 4-methoxyphenoxy group, a 4-carboxyphenoxy group, etc.), an acyloxy group (such as an acetoxy group, a tetradecanoyloxy group, a benzoyloxy group, etc.), a sulfonyloxy group (such as a methanesulfonyloxy group, a toluenesulfonyloxy group, etc.), an amido group (such as a dichloroacetylamino group, a heptafluorobutyrylamino group, a methanesulfonylamino group, a toluenesulfonylamino group, etc.), an alkoxycarbonyloxy group (such as an ethoxycarbonyloxy group, a benzyloxycarbonyloxy group, etc.), an aryloxycarbonyloxy group (such as a phenoxycarbonyloxy group, etc.), an aliphatic, aromatic or heterocyclic thio group (such as an ethylthio group, a phenylthio group, a tetrazolylthio group, etc.), an imido group (such as a succinimido group, a hydantoinyl group, etc.), an aromatic azo group (such as a phenylazo group), etc. These removable residues may optionally contain photographically functional groups.

$R_1$ in the formula (I) is preferably a linear or branched alkyl group having 2 to 15 carbon atoms, more preferably a linear or branched alkyl group having 2 to 4 carbon atoms, most preferably an ethyl group.

X in the formula (I) is preferably a hydrogen atom or a halogen atom, especially preferably a fluorine atom or a chlorine atom.

Z in the formula (I) is preferably a hydrogen atom, a halogen atom, an aryloxy group, an alkyloxy group or a sulfonamido group, especially preferably a fluorine atom or a chlorine atom.

R may be a divalent group to form a bis structure.

The cyan coupler of the present invention includes polymeric couplers containing a coupler residue of the formula (I) in the main chain or side chain of the polymer. In particular, a polymer derived from an ethylenically unsaturated compound containing the structure of the formula (I) is preferred. In this case, R represents a repeating unit and the bonding moiety thereof is contained in the main chain of the polymer.

Where R is a divalent group forming a bis structure, R is preferably an unsubstituted or substituted alkylene group (such as a methylene group, an ethylene group, a 1,10-decylene group, $-CH_2CH_2-O-CH_2CH_2-$, etc.), an unsubstituted or substituted phenylene group (such as a 1,4-phenylene group, a 1,3-phenylene group,

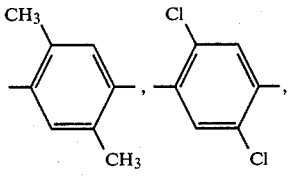

etc.), a group of the formula $-NHCO-R_2-CONH-$ (in which $R_2$ represents an unsubstituted or substituted alkylene or phenylene group, for example, $-NHCOCH_2CH_2CONH-$,

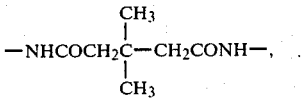

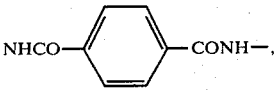

etc.), a group of the formula $-S-R_2-S-$ (in which $R_2$ represents an unsubstituted or substituted alkylene group, for example, $-S-CH_2CH_2-S-$,

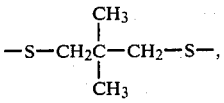

etc.), etc.

Where the component of the formula (I) is included in a vinyl monomer, the bonding group represented by R comprises a combination of groups selected from an alkylene group (that is, a substituted or unsubstituted alkylene group, for example, a methylene group, an ethylene group, a 1,10-decylene group, $-CH_2CH_2OCH_2CH_2-$, etc.), a phenylene group (that is, a substituted or unsubstituted phenylene group, for example, a 1,4-phenylene group, a 1,3-phenylene group,

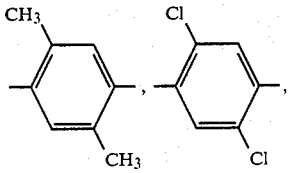

etc.), —NHCO—, —CONH—, —O—, —OCO— and an aralkylene group (such as

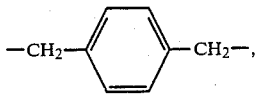

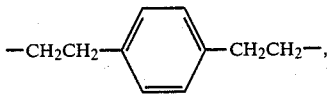

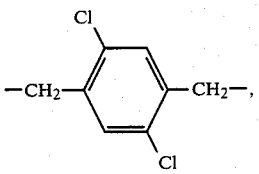

etc.).

Preferred bonding groups are mentioned below. —NHCO—, $-CH_2CH_2-$,

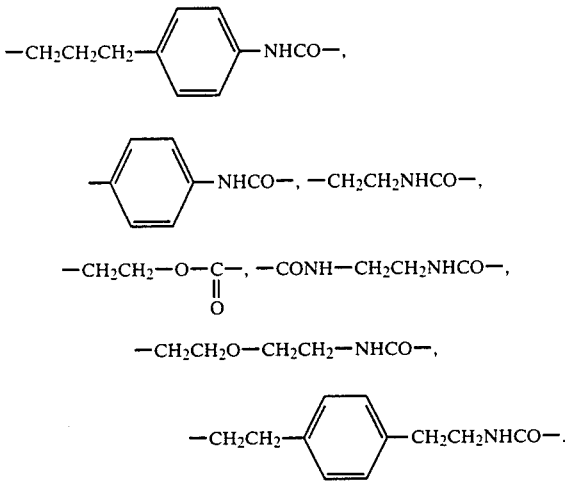

The vinyl monomer may further be substituted, in addition to the residue of the formula (I), preferably with a chlorine atom or a lower alkyl group having 1 to 4 carbon atoms (such as a methyl group, an ethyl group, etc.).

The monomer containing the component of the formula (I) may form a copolymer with a non-coloring ethylenic monomer which does not couple with an oxidized product of an aromatic primary amine developing agent.

Examples of non-coloring ethylenic monomers which do not couple with an oxidized product of an aromatic primary amine developing agent are acrylic acid, α-chloroacrylic acid, α-alacrylic acid (such as methacrylic acid, etc.) and esters and amides derived from acrylic acids (such as acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxyethyl methacrylate), a methylenedibisacrylamide, a vinyl ester (such as vinyl acetate, vinyl propionate and vinyl laurate), acrylonitrile, methacrylonitrile, an aromatic vinyl compound (such as styrene and derivatives thereof, vinyltoluene, divinylbenzene, vinylacetophenone and sulfostyrene), itaconic acid, citraconic acid, crotonic acid, vinylidene chloride, vinylalkylether (such as vinylethylether), maleic acid, maleic anhydride, maleate, N-vinyl-2-pyrrolidone, N-vinylpyridine, 2- and 4-vinylpyridines, etc. The non-coloring ethylenic unsaturated monomers may be used in the form of a mixture of two or more monomers thereof. For example, combinations of n-butylacrylate and methyl acrylate; styrene and methacrylic acid; methacrylic acid and acrylamide; methyl acrylate and diacetonacrylamide, etc., are suitable.

As well known in the field of polymer color couplers, the non-coloring ethylenic unsaturated monomer to be copolymerized with a solid and water-insoluble monomer coupler can be so selected that the non-coloring monomer has an advantageous influence upon the physical properties and/or chemical properties of the formed copolymer, such as solubility, compatibility with a binder present in a photographic colloid composition, e.g., gelatin, flexibility and thermal stability thereof.

The polymer couplers which may be used in the present invention may be either soluble in water or insoluble in water; and in particular, a polymer coupler latex is especially preferred.

Examples of cyan couplers of the present invention are described below. However, these couplers are not intended to be interpreted as limiting the scope of the present invention.

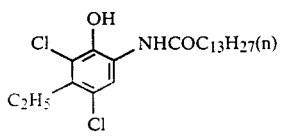

(1)

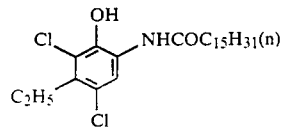

(2)

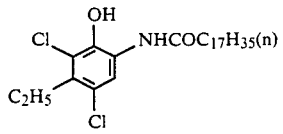

(3)

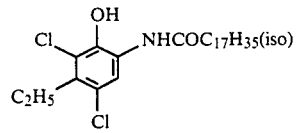

(4)

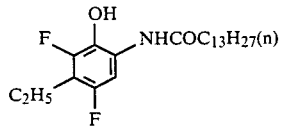

(5)

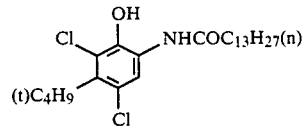

(6)

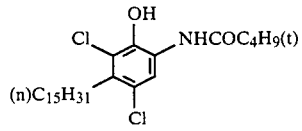

(7)

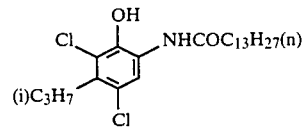

(8)

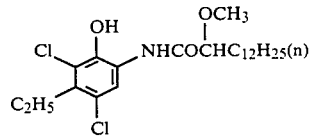

(9)

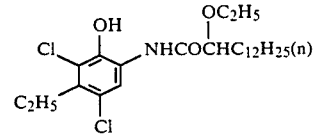

(10)

-continued (11)

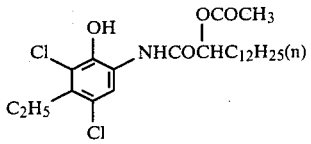

(12)

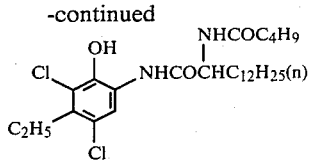

(13)

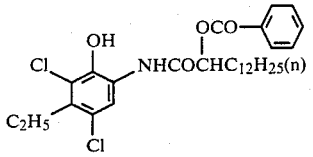

(14)

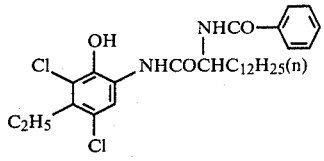

(15)

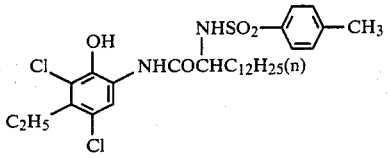

(16)

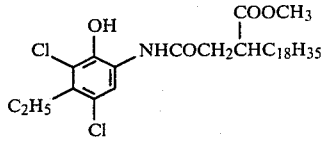

(17)

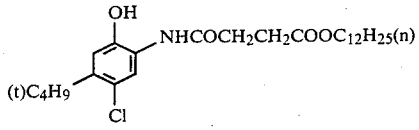

(18)

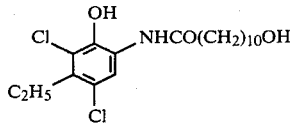

(19)

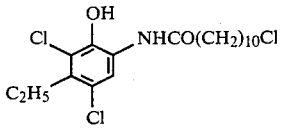

(20)

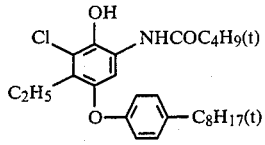

(21)

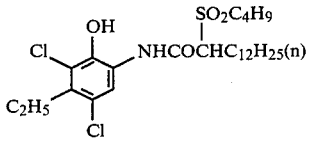

(22)

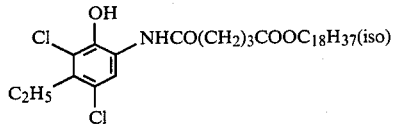

(23)

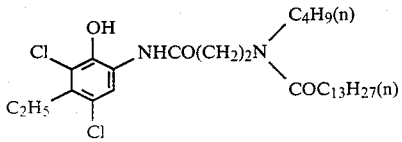

(24)

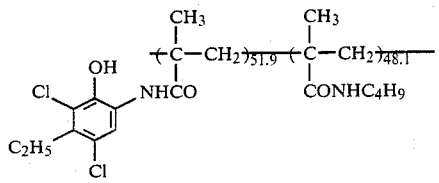

(25)

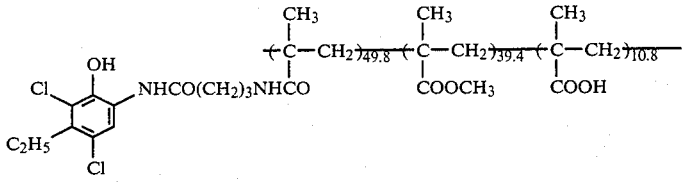

The following example illustrates the synthesis of the couplers of the present invention. Unless otherwise indicated herein, all parts, percents, ratios and the like are by weight.

SYNTHESIS EXAMPLE

Synthesis of the Starting Material of Coupler (1)

(1)

Synthesis of 2-nitro-4,6-dichloro-5-ethylphenol 306 g of 1,2-dichloroethane and 25.2 g of dioxane were placed in the four necked flask, and 42 g of sulfuric anhydride was dropped into the mixture with cooling at 25° C. or less. 68.1 g of 4-chloro-5-ethylphenol dissolved in 30 ml of 1,2-dichloroethane was added to the resulting mixture. Thereafter, the resulting mixture was stirred at 50° C. for 1 hour. The resulting mixture was cooled at 20° C. to precipitate the crystals of the sulfonic material and then this crystalline precipitate was dissolved in 75 ml of water. Furthermore, about 1.1 times theoretical value of the chlorine gas was passed through the resulting solution at 30° C. After blowing the chlorine gas, the resulting mixture was allowed to stand after stirring for 3 hours and, then the resulting mixture was added to the solution of 220 ml of water and 42.8 g of concentrated sulfuric acid at 30° C. or less.

Thereafter, the solvent layer of the lower layer of the resulting mixture was removed. 53 g of 62% nitric acid was added to the resulting mixture with stirring the water layer at 25° to 50° C., and then cooled for 1 hour at 5° C. or less to separate out 2-nitro-4,6-dichloro-5-ethylphenol. This crystalline precipitate was separated out, washed with water and dried. Yield was 77.3 g (75.3%), and melting point was 46.3° to 47.3° C.

(2)

Synthesis of 2-amino-4,6-dichloro-5-ethylphenol. hydrochloride 525 ml of isopropyl alcohol, 125 g of the same 2-nitro-4,6-dichloro-5-ethylphenol as described above in (1) and 7.5 g of Raney nickel were placed in 1 liter of autoclave, and then the mixture was stirred until absorbing the theoretical amount of hydrogen gas under 10 kg/cm$^2$ of initial pressure of hydrogen at 50° C. or less. Raney nickel catalysts were removed by filtration from the reaction mixture, and 165 g of concentrated hydrochloric acid was added to the resulting filtrate. Then, the resulting solution was stirred for 30 minutes at 40° to 50° C. to obtain white crystalline precipitates. Thereafter, the resulting crystal was cooled for 1 hour at 5° C. or less, and separated out, washed with 140 ml of acetone and dried to obtain 2-amino-4,6-dichloro-5-ethylphenol.hydrochloride. Yield was 112.5 g (87.5%).

Synthesis of Coupler (1)

10.0 g of 2-amino-4,6-dichloro-5-ethylphenol.hydrochloride, 10.7 g of myristoyl chloride, 40 ml of acetonitrile and 4 ml of dimethylacetamide were blended and refluxed for 60 minutes on a steam bath. Water was added to the reaction system, which was then extracted with ethyl acetate. The separated organic layer was washed with water and a salt aqueous solution and then dried with magnesium sulfate. The desiccant was filtered out and the solvent was evaporated off, whereby an oily yellow product was obtained. Acetonitrile and a small amount of ethyl acetate were added thereto for crystallization. The crystallized colorless crystals were removed by filtration and washed with acetonitrile and dried to obtain 14.2 g of Coupler (1). Melting point was 62° to 64° C. The elementary analysis thereof was given below.

| | H | C | N | Cl |
|---|---|---|---|---|
| Calculated Value (%) | 8.47 | 63.45 | 3.36 | 17.03 |
| Measured Value (%) | 8.38 | 63.49 | 3.29 | 17.11 |

Other couplers may be synthesized in the same manner as described above.

The coupler of the present invention may be incorporated in a photographic material in accordance with various known dispersion methods such as a solid dispersion method or an alkali dispersion method. In particular, a latex dispersion method is preferred, and an oil-in-water dispersion method is more preferred, which are representative means. In the oil-in-water dispersion method, the coupler is first dissolved in a single solution comprising either an organic solvent having a high boiling point of about 175° C. or higher or a solvent having a low boiling point (that is, a so-called auxiliary solvent) or in a mixture of a combination of both of these solvents; and then, the solution is finely dispersed in water or in an aqueous binder solution such as a gelatin solution in the presence of a surfactant. Examples of suitable high boiling point organic solvents are described in U.S. Pat. No. 2,322,027, etc. The dispersion may be accompanied by phase inversion. If necessary, the auxiliary solvent may be removed or amount reduced by distillation, noodle washing or ultrafiltration and thereafter the coupler containing dispersion may be coated on a photographic support.

Examples of suitable high boiling point organic solvents are phthalates (such as dibutyl phthalate, dicyclohexyl phthalate, di-2-ethylhexyl phthalate, didodecyl phthalate, etc)., phosphates and phosphonates (such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate, etc.), benzoates (such as 2-ethylhexyl benzoate, dodecyl benzoate, 2-ethylhexyl n-hydroxy benzoate, etc.), amides (such as diethyldodecanamide, N-tetradecylpyrrolidone, etc.), alcohols and phenols (such as isostearyl alcohol, 2,4-di-tert-amylphenol, etc.), aliphatic carboxylates (such as dioctyl azelate, glycerol tributylate, isostearyl lactate, trioctyl citrate, etc.), aniline derivatives (such as N,N-dibutyl-2-butoxy-5-tert-octylaniline, etc.), hydrocarbons (such as paraffin, dodecylbenzene, diisopropylnaphthalene, etc.), etc. Organic solvents having a boiling point of about 30° to 160° C. or so can be used as the auxiliary solvent, and representative examples thereof are ethyl acetate, butyl acetate, ethyl propionate, methyl ethyl ketone, cyclohexanone, 2-ethoxyethyl acetate, dimethylformamide, etc.

The procedures of the latex dispersion method and the effect thereof as well as examples of latexes to be used for immersion in this method are described in U.S. Pat. No. 4,199,363, etc.

The amount of the coupler of the present invention which is employed is, in general, about $1\times10^{-3}$ mol to about $7\times10^{-1}$ mol, preferably $1\times10^{-2}$ mol to $5\times10^{-1}$ mol, per mol of silver in the emulsion layer.

Various kinds of known couplers may be used in the photographic light-sensitive materials of the present invention together with the cyan coupler of the formula (I).

As the yellow coupler which may be used in the present invention, one representative example is an oil-protected acylacetamide type coupler. Specific examples thereof are described in, for example, U.S. Pat. Nos. 2,407,210, 2,875,057 and 3,265,506. In the present invention, a 2-equivalent yellow coupler is preferably used, and representative examples thereof are oxygen removing yellow couplers (which means yellow dye forming couplers containing an oxygen atom as the end atom of a residue removed upon coupling) as described in U.S. Pat. Nos. 3,408,194, 3,447,928, 3,933,501 and 4,401,752; and nitrogen removing yellow couplers (which mean yellow dye forming couplers containing a nitrogen atom as the end atom of a residue removed upon coupling) as described in Japanese Patent Publication No. 10739/83, U.S. Pat. Nos. 4,022,620 and 4,326,024, Research Disclosure, 18053 (April, 1979), British Pat. No. 1,425,020, German Pat. No. (OLS) Nos. 2,219,917, 2,261,361, 2,329,587 and 2,433,812. α-Pivaloylacetanilide type couplers are characterized by the color dye fastness thereof, and α-benzoylacetanilide type couplers are characterized by the good coloring property thereof.

As the magnenta coupler which may be used in the present invention are mentioned, for example, oil-protected indazolone type or cyanoacetyl type couplers, preferably 5-pyrazolone type and pyrazoloazole type couplers such as pyrazolotriazoles. Among the 5-pyrazolone type couplers, those having a 3-arylamino or 3-acylamino substituent are preferred in view of the color tone of the color dye and of the coloring speed. Examples of such couplers are described in U.S. Pat. Nos. 2,311,082, 2,343,703, 2,600,788, 2,908,573, 3,062,653, 3,152,896 and 3,936,015. 2-Equivalent 5-pyrazolone type couplers are preferred, which have as a removing group, preferably a nitrogen end removing group, as described in U.S. Pat. No. 4,310,619, or an arylthio removing group, as described in U.S. Pat. No. 4,351,897. 5-Pyrazolone type couplers having a ballast group as described in European Pat. No. 73,636 are preferred, as having high coloring reactivity.

As the pyrazoloazole type couplers are mentioned pyrazolobenzimidazoles as described in U.S. Pat. No. 3,369,897, preferably pyrazolo[5,1-c][1,2,4]triazoles as described in U.S. Pat. No. 3,725,067; pyrazolotetrazoles as described in *Research Disclosure,* 24220 (June, 1984); and pyrazolopyrazoles as described in *Research Disclosure,* 24230 (June, 1984). In particular, imidazopyrazoles as described in Japanese Patent Application (OPI) No. 162548/84 (the term "OPI" as used herein refers to a "published unexamined Japanese patent application") and pyrazolo[1,5-b][1,2,4]triazoles as described in Japanese Patent Application (OPI) No. 171956/84 are preferred, since these are free from yellow-by-absorption by the color images and have good light fastness.

Other cyan couplers than those of the formula (I), which may be used in the present invention, are oil-protected naphthol type and phenol type couplers. Representative examples thereof are naphthol type couplers as described in U.S. Pat. No. 2,474,293; preferably highly active 2-equivalent naphthol type couplers having an oxygen end removing group, as described in U.S. Pat. Nos. 4,052,212, 4,146,396, 4,228,233 and 4,296,200. Examples of phenol type couplers are described, for example, in U.S. Pat. Nos. 2,369,929, 2,423,730, 2,772,162 and 2,895,826.

Cyan couplers which are fast to heat, humidity and temperature are preferably used in the present invention, and representative examples thereof are phenol type cyan couplers as described in U.S. Pat. No. 3,772,002; 2,5-diacylamino-substituted phenol type couplers as described in U.S. Pat. Nos. 2,772,162, 3,758,308, 4,126,396, 4,334,011 and 4,327,175, and German Pat. (OLS) No. 3,329,729 and Japanese Patent Application (OPI) No. 166956/84; and phenol type couplers having 2-phenylureido and 5-acylamino substituents as described in U.S. Pat. Nos. 3,446,622, 4,333,999, 4,451,559 and 4,427,767.

In order to correct any unnecessary absorption in the short wavelength range by the color dyes from magenta and cyan couplers, a colored coupler is preferably incorporated in the photographic material. Representative examples of such colored couplers are yellow colored magenta couplers as described in U.S. Pat. No. 4,163,670 and Japanese Patent Publication No. 39413/82; and magenta colored cyan couplers as described in U.S. Pat. Nos. 4,004,929, 4,138,258 and British Pat. No. 1,146,368.

A black coloring coupler which is, in general, used in an X-ray photographic material for the purpose of economization of silver to be used may be used in the present invention, and examples of such couplers are described in U.S. Pat. No. 4,126,461 and British Pat. No. 2,102,136.

These color couplers may form a dimer or higher polymer. Typical examples of polymer couplers are described in U.S. Pat. Nos. 3,451,820 and 4,080,211. Examples of polymer magenta couplers are described in U.S. Pat. No. 4,367,282 and British Pat. No. 2,102,173.

In addition, a color diffusible type coupler may additionally be used in the present photographic light-sensitive material so as to improve the granularity thereof, and as for such couplers, examples of magenta couplers are described in U.S. Pat. No. 4,366,237 and British Pat. No. 2,125,570; and examples of yellow, magenta and cyan couplers are described in European Pat. No. 96,873 and German Pat. (OLS) No. 3,324,533.

The cyan couplers of the formula (I) of the present invention may be used in silver halide color photographic materials including color negative films, color papers, color positive films, color reversal films for slides, color reversal films for movies, color reversal films for TV, etc. In particular, these are especially suitable for color negative films and various types of color reversal films which require high sensitivity and high image quality. In addition, these may also be used in color papers.

In a photographic layer forming a conventional color paper, an ultraviolet absorbing agent is incorporated in either one layer, or preferably both layers which are adjacent to the cyan coupler containing the red-sensitive emulsion layer. Where the ultraviolet absorbing agent is to be added to an intermediate layer between the green-sensitive layer and the red-sensitive layer, this may be co-emulsified together with a color stain inhibitor. Where the ultraviolet absorbing agent is to be added to a protective layer, another outermost layer may be superposed on the protective layer. The protective layer may contain a matting agent having any desired particle size.

The above mentioned ultraviolet absorbing agent is dissolved in a single solvent such as a high boiling agent organic solvent or a low boiling point organic solvent or in a mixture thereof and then dispersed in a hydrophilic colloid in a similar manner to the above described coupler. The amount of the high boiling point organic solvent and that the ultraviolet absorbing agent to be used are not specifically limited, and, in general, the amount (weight) of the high boiling point organic solvent to be used is within the range of 0 to 300%, on the basis of the weight of the ultraviolet absorbing agent employed. The single use or combination use of compounds which are liquid at normal temperature is preferred.

When the benzotriazole type ultraviolet absorbing agent is used together with the combination of the couplers of the present invention, the preservability of the colored images especially cyan color images may be improved, in particular, the light fastness thereof is especially improved. The ultraviolet absorbing agent and cyan coupler may be co-emulsified.

The amount of the ultraviolet absorbing agent to be coated is sufficient to be such that may impart light stability to the formed cyan color images. However, if the amount of the ultraviolet absorbing agent is too large, the non-exposed area (white part) of the color photographic light-sensitive material sometimes becomes yellow. Accordingly, the amount is, in general, preferably within the range of about $1\times10^{-4}$ mol/m$^2$ to about $2\times10^3$ mol/m$^2$, especially preferably $5\times10^{-4}$ mol/m$^2$ to $1.5\times10^{-3}$ mol/m$^2$.

In order to improve the preservation stability of colored images, especially yellow and magenta images, various kinds of organic or metal complex anti-fading agents may be used in the photographic light-sensitive materials of the present invention. Examples of organic anti-fading agents are hydroquinones, gallic acid derivatives, p-alkoxyphenols and p-oxyphenols; and color image stabilizers, stain inhibitors and antioxidants are described in patent specifications which are referred to in *Research Disclosure* (RD) 17643 (No. VII, Paragraphs I through J). Metal complex type anti-fading agents are described in *Research Disclosure,* 15162, etc.

In order to improve the fastness of yellow color images to heat and light, various kinds of compounds may be used, for example, phenols, hydroquinones, hydroxycoumarones, hydroxycoumarans, hindered amines and alkylethers and silylethers thereof as well as hydrolyzable precursor derivatives thereof.

Various kinds of silver halides may be used in the silver halide emulsion layers of the color photographic light-sensitive materials of the present invention. For example, silver chloride, silver bromide, silver chlorobromide, silver iodobromide and silver chloroiodobromide may be used. In particular, silver iodobromide containing 2 to 20 mol% of silver iodide and silver chlorobromide containing 10 to 50 mol% of silver bromide are preferred. The crystal form, crystal structure, grain size and grain distribution of silver halide particles are not specifically limited. Crystals of silver halide particles may be either the normal crystal form or the twin crystal form, and may be any of hexahedron, octahedron and tetradecahedron. In addition, the crystals may be in the form of plate like shaped particles having a thickness of about 0.5$\mu$ or less, a diameter of at least 0.6$\mu$ and an average aspect ratio of 5 or more, which are described in *Research Disclosure,* 22534.

The crystal structure of the silver halide particles may either be uniform or comprise different inner and outer constitutions, or otherwise, may have a laminated structure. Apart from these, silver halides having different compositions may be bonded by epitaxial bond. or the silver halides may comprise a mixture of particles having various crystal forms. Latent images may be substantially formed either on the surface of silver halide particles or in the inner part thereof.

The particle size of the silver halides may either be small to form fine particles having a grain diameter of about 0.1$\mu$ or less or be large to form large particles having a projected area diameter of up to about 3$\mu$; and in addition, the silver halide particles may form either a monodispersed emulsion having a narrow particle size distribution or a polydispersed emulsion having a broad particle size distribution.

The silver halide particles may be obtained by conventional methods which are well known in the art.

The silver halide emulsion of the present invention may be sensitized using conventional chemical sensitization methods such as a sulfur sensitization or a noble metal sensitization or a combination thereof. In addition, the silver halide emulsion of the present invention may be spectrally sensitized in order to impart a spectral sensitivity to the emulsion in a desired photographic wavelength range, by the use of a sensitizing dye. Preferred dyes which may advantageously be used in the present invention for this purpose are, as explained in detail in the following description, methine dyes and styryl dyes such as cyanine, hemicyanine, rhodacyanine, merocyanine, oxonol and hemioxonol, and these may be used alone or in the form of a mixture of two or more dyes.

As a support of the photographic light-sensitive materials of the present invention, any of a transparent support such as polyethylene terephthalate or cellulose triacetate or a reflective support as mentioned below may be used. The reflective support is more preferred, for example, including baryta paper, polyethylene coated paper and polypropylene type synthetic paper as well as transparent supports having a reflective layer thereon or containing a reflective substance therein. Examples of transparent supports of the reflective supports are a glass sheet, a polyester film such as polyethylene terephthalate, cellulose triacetate and cellulose nitrate, a polyamide film, a polycarbonate film, a polystyrene film, etc. These supports may freely be selected in accordance with the use and the object of the photographic materials.

Each of the blue-sensitive, green-sensitive and red-sensitive emulsions of the present invention are spectrally sensitized by a methine dye, etc., in order to impart the respective color sensitivity to each emulsion. Dyes which may be used for this purpose of spectral sensitization include cyanine dyes, merocyanine dyes, complex cyanine dyes, complex merocyanine dyes, holopolar cyanine dyes, hemicyanine dyes, styryl dyes and hemioxonol dyes. Especially valuable dyes are those belonging to cyanine dyes, merocyanine dyes and complex merocyanine dyes.

The color photographic light-sensitive materials of the present invention may have, in addition to the above described layers, other auxiliary layers such as a subbing layer, an intermediate layer, a protective layer, etc. If necessary, a second ultraviolet absorption layer may be provided between the red-sensitive silver halide emulsion layer and the green-sensitive silver halide emulsion layer. The above mentioned ultraviolet absorbing agent is preferably used in the second ultraviolet absorption layer, or otherwise, other known ultraviolet absorbing agents may of course be used in this layer.

Gelatin is preferably and advantageously used as a binder or a protective colloid of the photographic emulsion of the present invention. Other hydrophilic colloids may of course be used therefor.

For example, the following substances may be used: gelatin derivatives, graft polymers of gelatin with other high molecular weight compounds, proteins such as albumin, casein, etc.; cellulose derivatives such as hydroxyethyl cellulose, carboxymethyl cellulose, cellulose sulfates, etc.; saccharide derivatives such as sodium alginate, starch derivatives, etc.; and other various kinds of synthetic hydrophilic high molecular weight substances of mono- or copolymers such as polyvinyl alcohol, partially acetalized polyvinyl alcohol, poly-N-vinylpyrrolidone, polyacrylic acid, polymethacrylic acid, polyacrylamide, polyvinylimidazole, polyvinylpyrazole, etc.

As the gelatin substance may be used a lime-treated gelatin and an acid-treated gelatin, as well as an enzyme-treated gelatin as described in *Bull. Soc. Sci. Phot. Japan,* No. 16, page 30 (1966). In addition, hydrolyzed products of enzyme decomposed products of gelatin may also be used therefor.

In the photographic light-sensitive materials of the present invention, the photographic emulsion layer(s)

and/or hydrophilic colloid layer(s) may contain a whitening agent such as a stilbene type, triazine type, oxazole type or coumarine type whitening agent. The whitening agents may be either soluble or insoluble in water, and water-insoluble whitening agents may be used in the form of a dispersion. Examples of brightening agents are described in U.S. Pat. Nos. 2,632,701, 3,269,840 and 3,359,102, British Pat. Nos. 852,075 and 1,319,763, and *Research Disclosure,* No. 176, 17643 (December, 1978), page 24, lines 9–36 "Brighteners", etc.

When the hydrophilic colloid layer of the photographic light-sensitive materials of the present invention contains a dye and/or an ultraviolet absorbing agent, these may be mordanted by the use of a cationic polymer or the like.

The color photographic light-sensitive materials of the present invention may further contain, if desired, in addition to the above mentioned additives, other various kinds of photographic additives which are known in this technical field, such as a stabilizer, an antifoggant, a surfactant, other couplers than that of the present invention, a filter dye, an irradiation inhibiting dye and/or a developing agent; and examples of such additives are described in *Research Disclosure* (17643).

In addition, the photographic light-sensitive materials of the present invention may optionally contain, in the silver halide emulsion layer or in another hydrophilic colloid layer, fine silver halide emulsion particles which do not have any substantial photographic sensitivity, such as silver chloride, silver bromide or silver chlorobromide emulsion having an average particle size of about 0.20$\mu$ or less.

As the color developing solution used for color development of the photographic light-sensitive materials of the present invention, an alkaline aqueous solution is preferred, containing a main component of an aromatic primary amine type color developing agent. Representative examples of color developing agents are 4-amino-N,N-diethylaniline, 3-methyl-4-N,N-diethylaniline, 4-amino-N-ethyl-$\beta$-hydroxyethylaniline, 3-methyl-4-amino-N-ethyl-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.

The color developing solution may contain a pH buffer agent such as an alkali metal sulfite, carbonate, borate and phosphate, as well as a bromide, an iodide and a development retarder or an antifoggant such as an organic antifoggant. The color developing solution may further contain, if desired, a water softener, a preservative such as a hydroxylamine, an organic solvent such as benzyl alcohol and diethylene glycol, a development accelerator such as polyethylene glycol, quaternary ammonium salts and amines, a color forming coupler, a competing coupler, a fogging agent such as a sodium borohydride, an auxiliary developing solution such as 1-phenyl-3-pyrazolidone, a tackifier, a polycarboxylic acid chelating agent as described in U.S. Pat. No. 4,083,723, and an antioxidant as described in German Patent (OLS) No. 2,622,950.

The photographic emulsion layer is, after the color development treatment, in general, subjected to a bleaching treatment. This bleaching treatment may be carried out simultaneously with a fixing treatment, or alternatively, may be carried out separately. As the bleaching agent, for example, polyvalent metal compounds such as iron (III), cobalt (III), chromium (VI) or copper (II) compounds, and peracids, quinones and nitroso compounds, etc., may be used. For instance, ferricyanides, bichromates and iron (III) or cobalt (III) organic complexes, for example, with an organic acid such as an ethylenediaminetetraacetic acid, a nitrilotriacetic acid, an aminopolycarboxylic acid (e.g., 1,3-diamino-2-propanoltetraacetic acid), citric acid, tartaric acid or malic acid; persulfates and permanganates; and nitrosophenols, etc., may be used. In particular, potassium ferricyanide, sodium ethylenediaminetetraacetate iron (III) and ammonium ethylenediaminetetraccetate iron (III) are especially useful among them. Ethylenediaminetetraacetic acid iron (III) complexes are useful either in an independent bleaching solution or in a one bath type bleaching-fixing solution.

After the color development or bleaching-fixing treatment, the photographic material may be rinsed with water. The color development may be carried out at a desired temperature falling within the range of 18° C. to 55° C., and is preferably carried out at 30° C. to 55° C., more preferably at 35° C. to 55° C. The development time is within the range of about 1 minute to 3.5 minutes, and is preferably shorter. In a continuous development treatment, the developing solution is preferably supplemented during the development, for example, it is preferred to supplement the developing solution in an amount of 330 to 160 cc, more preferably 100 cc or less, per $m^2$ of the area of the photographic material to be treated. The content of benzyl alcohol in the developing solution is preferably about 5 ml/l or less.

The bleaching-fixing treatment may be carried out at a desired temperature falling within the range of about 18° C. to about 50° C., and is preferably carried out at 30° C. or higher. In the case where the bleaching-fixing treatment is carried out at 35° C. or higher, the treatment time may be 1 minute or less, and the amount of the developing solution to be supplemented may be reduced. The time required for rinsing treatment to be carried out after the color development or the bleaching-fixing treatment is in general within 3 minutes, or otherwise, in the case where a stabilized bath is used, the rinsing treatment may substantially be omitted.

The developed colors are deteriorated due to light, heat and temperature, and in addition, these are often deteriorated microbially during preservation. In particular, cyan color images tend to be seriously deteriorated microbially, and it is preferred to use an antifungal agent. Examples of antifungal agents are 2-thiazolylbenzimidazoles as described in Japanese Patent Application (OPI) No. 157244/82. The antifungal agent may either be internally incorporated in the components of the photographic material or be added thereto during the development step. The antifungal agent may be added to the photographic material in any stage of the treatment thereof, so long as the agent is incorporated in the treated photographic material.

The present invention is explained in greater detail by reference to the following examples, which, however, are not intended to be interpreted as limiting the scope of the present invention.

EXAMPLE

A first layer (innermost layer) to a seventh layer (outermost layer) were coated on a polyethylene laminated paper, the polyethylene being laminated on both surfaces of the paper, as described in Tables I and II below, to form Samples (A) through (O) of various kinds of color photographic light-sensitive materials.

The coating solution of the first layer was prepared as follows: 100 g of the yellow coupler shown in Table I was dissolved in a mixed solution comprising 166.7 ml of dibutyl phthalate (DBP) and 200 ml of ethyl acetate, and the resulting solution was emulsified and dispersed in 800 g of a 10% gelatin aqueous solution containing 80 ml of a 1% sodium dodecylbenzenesulfonate aqueous solution. Next, all of the emulsified dispersion was blended with 1,450 g of a blue-sensitive silver chlorobromide emulsion (Br: 80%), containing 66.7 g of Ag, to obtain a coating solution. Other coating solutions of other layers were prepared in a similar manner. As a hardening agent in each layer sodium 2,4-dichloro-6-hydroxy-s-triazine was used.

-continued

Red-Sensitive Emulsion Layer:

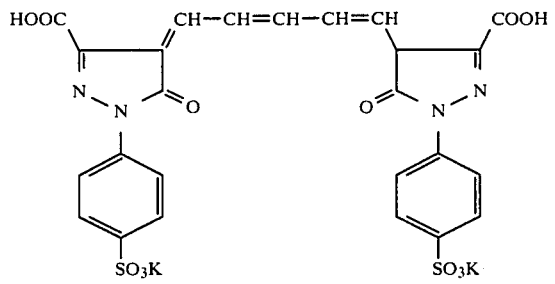

TABLE I

| | | |
|---|---|---|
| 7th Layer (protective layer | Gelatin | 1,500 mg/m$^2$ |
| 6th Layer (ultraviolet absorption layer) | Ultraviolet absorbing agent (III-3/III-1/III-4) | 50/150/300 mg/m$^2$ |
| | Solvent for ultraviolet absorbing agent (DBP) | 200 mg/m$^2$ |
| | Gelatin | 1,500 mg/m$^2$ |
| 5th Layer (red-sensitive layer) | Silver chlorobromide emulsion (silver bromide: 50 mol %) | 300 mg/m$^2$ (silver) |
| | Cyan coupler | Table II |
| | Ultraviolet absorbing agent (III-3/III-1/III-4) | 40/80/100 mg/m$^2$ |
| | Anti-fading agent (*a) | 200 mg/m$^2$ |
| | Cyan coupler solvent (DBP) | 240 mg/m$^2$ |
| | Gelatin | 600 mg/m$^2$ |
| 4th Layer (ultraviolet absorption layer) | Ultraviolet absorbing agent (III-3/III-1/III-4) | 15/45/90 mg/m$^2$ |
| | Ultraviolet absorbing agent solvent (DBP) | 60 mg/m$^2$ |
| | Gelatin | 500 mg/m$^2$ |
| 3rd Layer (green-sensitive layer) | Silver chlorobromide (silver bromide: 70 mol %) | 450 mg/m$^2$ (silver) |
| | Magenta coupler (*b) | 350 mg/m$^2$ |
| | Anti-fading agent (*c/*d) | 50/100 mg/m$^2$ |
| | Magenta coupler solvent (TOP) | 440 mg/m$^2$ |
| | Gelatin | 1,000 mg/m$^2$ |
| 2nd Layer (color stain inhibition layer) | Gelatin | 1,500 mg/m$^2$ |
| 1st Layer (blue-sensitive layer) | Silver chlorobromide emulsion (silver bromide: 80 mol %) | 400 mg/m$^2$ |
| | Yellow coupler (*e) | 600 mg/m$^2$ |
| | Anti-fading agent (*f) | 150 mg/m$^2$ |
| | Yellow coupler solvent (DBP) | 600 mg/m$^2$ |
| | Gelatin | 1,200 mg/m$^2$ |
| Support | Paper support laminated with polyethylene on both sides | |

The following spectral sensitizers were used in the respective emulsions.

Blue-Sensitive Emulsion Layer:

Sodium 3,3'-di(γ-sulfopropyl)selenacyanine ($2\times10^{-4}$ mol per mol of silver halide).

Green-Sensitive Emulsion Layer:

Sodium 3,3'-di-(γ-sulfopropyl)-5,5'-diphenyl-9-ethyloxacarbocyanine ($2.5\times10^{-4}$ mol per mol of silver halide).

Red-Sensitive Emulsion Layer:

Sodium 3,3'-di(γ-sulfopropyl)-9-methylthiadicarbocyanine ($2.5\times10^{-4}$ mol per mol of silver halide).

The following irradiation inhibiting dyes were used in the respective emulsion layers.

Green-Sensitive Emulsion Layer:

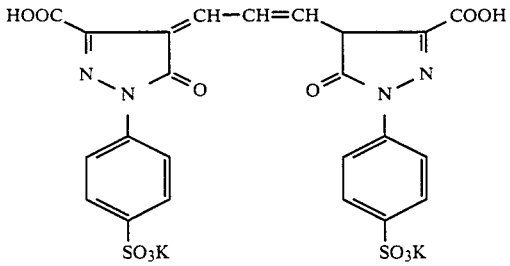

In Table I, ultraviolet absorbing agents (III-1), (III-3) and (III-4) are represented by the following formulae.

Ultraviolet Absorbing Agent (III-1)

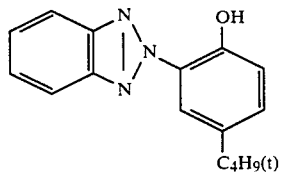

Ultraviolet Absorbing Agent (III-3)

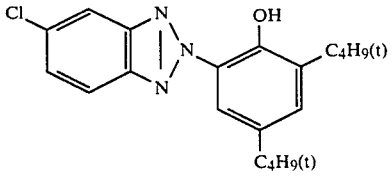

Ultraviolet Absorbing Agent (III-4)

-continued

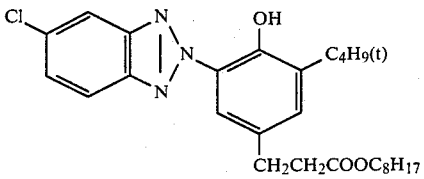

TABLE II

| Sample | Cyan Coupler | Coated Amount | Remarks |
|---|---|---|---|
| A | (1) | 340 mg/m$^2$ | Present Invention |
| B | (4) | 380 mg/m$^2$ | Present Invention |
| C | (8) | 350 mg/m$^2$ | Present Invention |
| D | (10) | 370 mg/m$^2$ | Present Invention |
| E | (14) | 430 mg/m$^2$ | Present Invention |
| F | (18) | 320 mg/m$^2$ | Present Invention |
| G | (1)/(*g) | 170/250 mg/m$^2$ | Present Invention |

TABLE II-continued

| Sample | Cyan Coupler | Coated Amount | Remarks |
|---|---|---|---|
| H | (4)/(*g) | 190/250 mg/m$^2$ | Present Invention |
| I | (14)/(*g) | 215/250 mg/m$^2$ | Present Invention |
| J | (*h) | 400 mg/m$^2$ | Comparative Sample |
| K | (*i) | 410 mg/m$^2$ | Comparative Sample |
| L | (*j) | 420 mg/m$^2$ | Comparative Sample |
| M | (*h)/(*g) | 200/250 mg/m$^2$ | Comparative Sample |
| N | (*i)/(*g) | 205/250 mg/m$^2$ | Comparative Sample |
| O | (*j)/(*g) | 210/250 mg/m$^2$ (silver chloro-bromide emulsion, silver: 600 mg/m$^2$) | Comparative Sample |

In the above Tables, DBP is dibutyl phthalate, TOP is tri(n-octyl phthalate), and the chemical structure of compounds (*a) through (*j) are as follows:

(*a) Anti-Fading Agent:

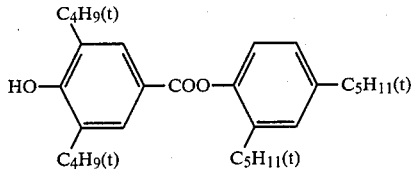

(*b) Magenta Coupler:

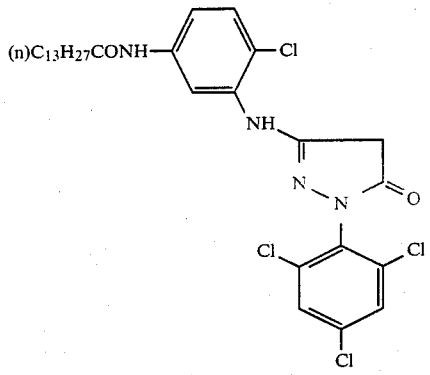

(*c) Anti-Fading Agent:

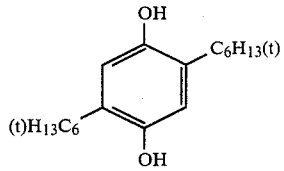

(*d) Anti-Fading Agent:

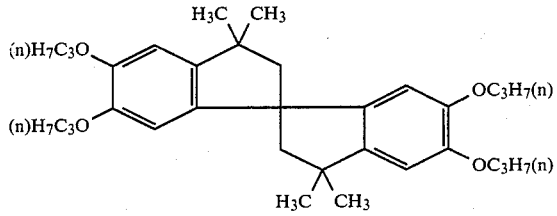

-continued (*e) Yellow Coupler:

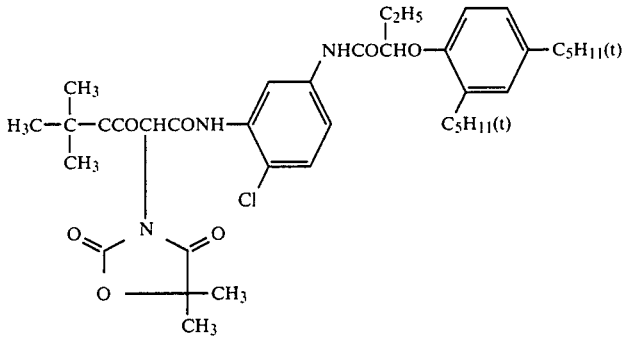

(*f) Anti-Fading Agent:

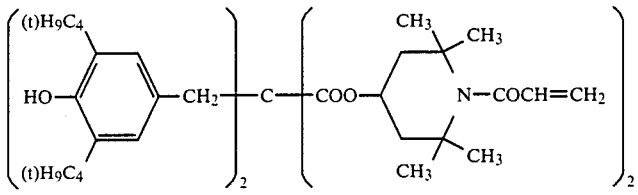

(*g) Cyan Coupler:

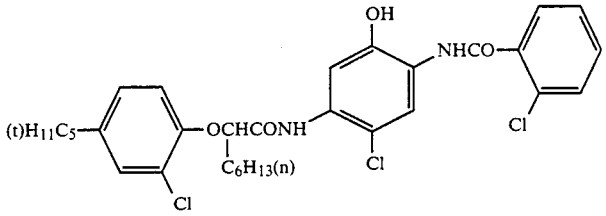

(*h) Cyan Coupler:

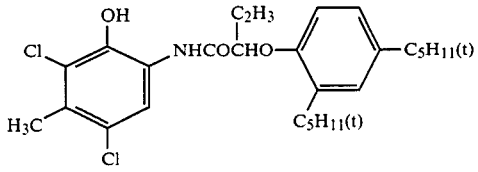

(*i) Cyan Coupler:

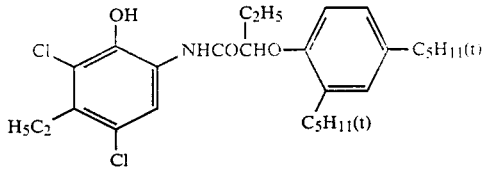

(*j) Cyan Coupler:

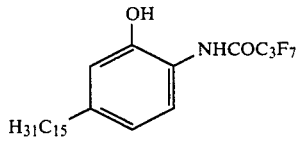

(described in U.S. Pat. No. 2,895,826).

These samples were exposed to red light using a continuous exposure wedge and then subjected to a development treatment according to the following steps:

| | Treatment Steps | |
|---|---|---|
| | Temperature (°C.) | Time (min) |
| Developing Solution | 33 | 3.5 |
| Bleach-Fixing Solution | 33 | 1.5 |
| Rinse with Water | 28 to 35 | 3 |

The treatment solutions used in the treatment steps had the following formulation:

| Developing Solution: | |
|---|---|
| Benzyl Alcohol | 15 ml |
| Diethylene Glycol | 8 ml |
| Disodium Ethylenediaminetetraacetate | 5 g |
| Sodium Sulfite | 2 g |
| Hydroxylamine Sulfate | 3 g |
| 4-Amino-N—ethyl-N—(β-methanesulfonamidoethyl)-m-toluidine.$\frac{2}{3}$ sulfate.$1H_2O$ | 5 g |
| Water to make | 1,000 ml |
| pH | adjusted to |

-continued

| Developing Solution: | |
|---|---|
| | 10.20 |

| Bleach-Fixing Solution: | |
|---|---|
| Disodium Ethylenediaminetetraacetate | 2 g |
| Ferric Ethylenediaminetetraacetate | 40 g |
| Sodium Sulfite | 5 g |
| Ammonium Thiosulfate | 70 g |
| Water to make | 1,000 ml |
| pH | adjusted to 6.80 |

After the development, each sample was then subjected to a color deterioration test under the following conditions:

(1) Irradiated with a xenon tester (illuminance: 130,000 luxes) for 12 days (2) Stored at 80° C. for 4 weeks.

(3) Stored at 60° C., 70% RH for 8 weeks.

The density of each sample was measured after the color deterioration test, and the results obtained are given in Table III below, the density of each sample before the test being 1.0 for comparison.

TABLE III

| | Cyan Density (initial density = 1.0) | | |
|---|---|---|---|
| Sample No. | Xenon Ray Irradiation (12 days) | Stored at 80° C., for 4 Weeks | Stored at 60° C., 70% RH, for 8 Weeks |
| A (Present Invention) | 0.90 | 0.86 | 0.89 |
| B (Present Invention) | 0.92 | 0.87 | 0.90 |
| C (Present Invention) | 0.88 | 0.89 | 0.90 |
| D (Present Invention) | 0.90 | 0.88 | 0.91 |
| E (Present Invention) | 0.89 | 0.90 | 0.89 |
| F (Present Invention) | 0.91 | 0.88 | 0.90 |
| G (Present Invention) | 0.81 | 0.95 | 0.97 |
| H (Present Invention) | 0.83 | 0.97 | 0.96 |
| I (Present Invention) | 0.80 | 0.96 | 0.94 |
| J (Comparative Sample) | 0.76 | 0.63 | 0.72 |
| K (Comparative Sample) | 0.72 | 0.88 | 0.90 |
| L (Comparative Sample) | 0.44 | 0.85 | 0.89 |
| M (Comparative Sample) | 0.66 | 0.81 | 0.84 |
| N (Comparative Sample) | 0.45 | 0.96 | 0.97 |
| O (Comparative Sample) | 0.60 | 0.95 | 0.97 |

From the results in Table III, it can be seen that:

(1) Sample Nos. (A) through (F) of the present invention are markedly less deteriorated than Comparative Sample No. (J) in every test. In addition, these Samples (A) to (F) of the present invention are markedly less deteriorated in xenon irradiation test than Comparative Sample Nos. (K) through (L).

(2) Sample Nos. (G) through (I) of the present invention are markedly less deteriorated in the xenon irradiation test than Comparative Sample Nos. (M) through (O).

As is apparent from the above test results, all samples of the present invention had good color image fastness against light, heat and heat in the presence of humidity; and in particular, it is apparent that the photographic light-sensitive materials of the present invention have very excellent color image fastness against light.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material containing a cyan coupler of the general formula (I):

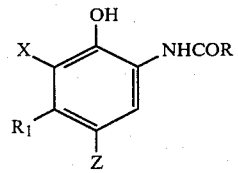

(I)

wherein R represents an unsubstituted linear or branched aliphatic group or a linear or branched aliphatic group substituted with one or more substituents selected from the group consisting of a chlorine atom, an alkoxy group, an alkylthio group, an arylthio group, an alkylsulfonyl group, an arylsulfonyl group, a sulfonamido group, an acylamino group, an alkyloxycarbonyl group, an aryloxycarbonyl group, a carbamoyl group, an alkylcarbonyloxy group, an arylcarbonyloxy group, a carboxyl group and a hydroxyl group; $R_1$ represents a linear or branched alkyl group having 2 to 4 carbon atoms; X is a fluorine atom or a chlorine atom; and Z is a fluorine atom or a chlorine atom.

2. The silver halide color photographic light-sensitive material as claimed in claim 1, wherein R in the formula (I) represents an unsubstituted linear or branched aliphatic group, which has 1 to 32 carbon atoms and which may contain one or more unsaturated bonds; or R represents a linear or branched aliphatic group, which has 1 to 32 carbon atoms and is substituted with one or more substituents selected from the group consisting of a chlorine atom, a carboxyl group, an alkoxy group, an alkylthio group, an arylthio group, an alkylsulfonyl group, an arylsulfonyl group, a sulfonamido group, an acylamino group, an alkyloxycarbonyl group, an aryloxycarbonyl group, a carbamoyl group, an alkylcarbonyloxy group, an arylcarbonyloxy group, and a hydroxyl group.

* * * * *